US007497041B1

(12) United States Patent
Laurence

(10) Patent No.: US 7,497,041 B1
(45) Date of Patent: Mar. 3, 2009

(54) INSPIRATIONAL CONTAINER AND BOOKLET

(76) Inventor: Timothy Laurence, 9743 Lurline Ave., Chatsworth, CA (US) 91311

( * ) Notice: Subject to any disclaimer, the term of this patent is extended or adjusted under 35 U.S.C. 154(b) by 0 days.

(21) Appl. No.: 11/418,364

(22) Filed: May 4, 2006

(51) Int. Cl.
*G09F 3/10* (2006.01)

(52) U.S. Cl. ..... 40/638; 40/306

(58) Field of Classification Search ..... 40/638, 40/306, 310; 283/81
See application file for complete search history.

(56) References Cited

U.S. PATENT DOCUMENTS 4,397,417 A * 8/1983 Carlson ..... 229/92.3
4,621,442 A * 11/1986 Mack ..... 40/638
4,850,611 A * 7/1989 Skelton ..... 281/5
4,967,951 A * 11/1990 Sherman ..... 229/70
5,727,819 A * 3/1998 Grosskopf et al. ..... 283/81
5,829,789 A * 11/1998 Treleaven et al. ..... 283/81
6,432,500 B1 * 8/2002 Jones et al. ..... 428/40.1
2001/0036524 A1 * 11/2001 Anderson ..... 428/40.1
2004/0041392 A1 * 3/2004 Seidl ..... 283/81

OTHER PUBLICATIONS

Head, Brandon, "The Food of the Gods," http://www.gutenberg.org/files/16035/16035-h/16035-h.htm, Dec. 1903.*
"America's Voting Patchwork," http://web.archive.org/web/20050206125621/http://americanhistory.si.edu/vote/patchwork.html, Feb. 6, 2005.*

* cited by examiner

*Primary Examiner*—Gary C Hoge
(74) *Attorney, Agent, or Firm*—Colin P. Abrahams

(57) ABSTRACT

A container and booklet combination comprises a container having walls defining a space, the walls having at least an insert aperture, and a booklet comprising a plurality of media sheets mounted on at least a portion of the outer surface of the container in a manner which allows removal of one of the media sheets from the plurality of media sheets, the media sheets being configured so as to be placed in the container through the insert aperture.

10 Claims, 4 Drawing Sheets

INSPIRATIONAL CONTAINER AND BOOKLET

FIELD AND BACKGROUND OF THE INVENTION

This invention relates to a container with a an attached booklet typically but not necessarily used for writing and storing messages of an inspirational and/or spiritual nature. More particularly, the invention is for a container having an opening or inlet for receiving written messages, and a sleeve, label or sheath which fits about at least a part of the container and which includes a booklet, pages or writing material in some other form. In accordance with an embodiment of the invention, a one or more pages or paper pieces can be selectively removed from the surrounding sheath or cover of the container, written on, so as to create a message, and the paper with the message thereafter deposited within the can or container.

While the invention is not to be construed as limited in this regard, it does have particular application and relevance for use by religious individuals or people who are spiritually inclined, and may be positioned in various places around the home, office or other desired locations for ready use upon the inspiration or need of the user.

SUMMARY OF THE INVENTION

According to one aspect of the invention, there is provided a container and booklet combination comprising a container having walls defining a space, the walls having at least an insert aperture; and a booklet comprising a plurality of media sheets mounted on at least a portion of the outer surface of the container in a manner which allows removal of one of the media sheets from the plurality of media sheets, the media sheets being configured so as to be placed in the container through the insert aperture.

Preferably, the container is cylindrical, and the media sheets are comprised of paper. The container conveniently comprises side walls, a closed lower wall and an upper wall having an opening or slot therein.

In one form, the booklet is mounted on a label, the label being mounted on the container. Further, the label may comprise material of an inspirational or spiritual nature.

Preferably, the booklet comprises a plurality of media sheets mounted over each other in a stacked formation, and joined along a common edge thereof. Alternately, the media sheets are folded in a zigzag fashion, each media sheet being separated from its adjacent media sheets by a score line to facilitate easy removal of a media sheet. The booklet may have a cover thereover, the cover having a fastening edge for fastening the sheets on the label. In one embodiment, the cover edge has an adhesive thereon which allows multiple separation and re-adherence of the cover edge to the label.

In one aspect of the invention, there is therefore provided a container defining a space, an opening in the container, and a booklet, pages, or peel-off pages formed in a stored fashion about the container, the pages being removable from the booklet or source when needed. Further, the container may provide for a writing implement to be attached thereto, preferably removably, also conveniently ready use by the user.

Preferably, the container is cylindrical, and has a label surrounding it. The label may have a wide variety of different pictures, colors, abstractions or the like, which may enhance the inspirational and/or spiritual tone of the container of the invention. Furthermore, or as an alternative, the label may have various forms of writing, such as biblical passages, prayers, or other writings, preferably of a religious or inspirational nature, intended to motivate a user to create messages and deposit them in the container.

The invention thus relates to a container, and usable paper sheets, pages or other writing media, surrounding or mounted on the container, individual sheets or pages being readily removable from the plurality of pages or sheets, so that a message can be written thereon and deposited in the container.

The pages or sheets may completely surround the container, or they may be mounted on a label or sleeve which itself surrounds the container.

DETAILED DESCRIPTION OF THE INVENTION

The invention generally relates to a container, which can assume a wide variety of shapes, configurations and sizes, and a booklet or plurality of pages mounted on the container in a manner which allows one page from the plurality of pages to be removed, so that a message can be written thereon and deposited within the container.

The plurality of pages may be in the form of a booklet, where the pages are bound at one edge, or the pages are arranged in a zigzag configuration, preferably with tear-lines between pages for easy removal of one page from its adjacent pages. In another format, the pages can be separate, or substantially separate, from each other and mounted at different places on or about the container for peel-off and removal on an as needed basis.

Figure 1:
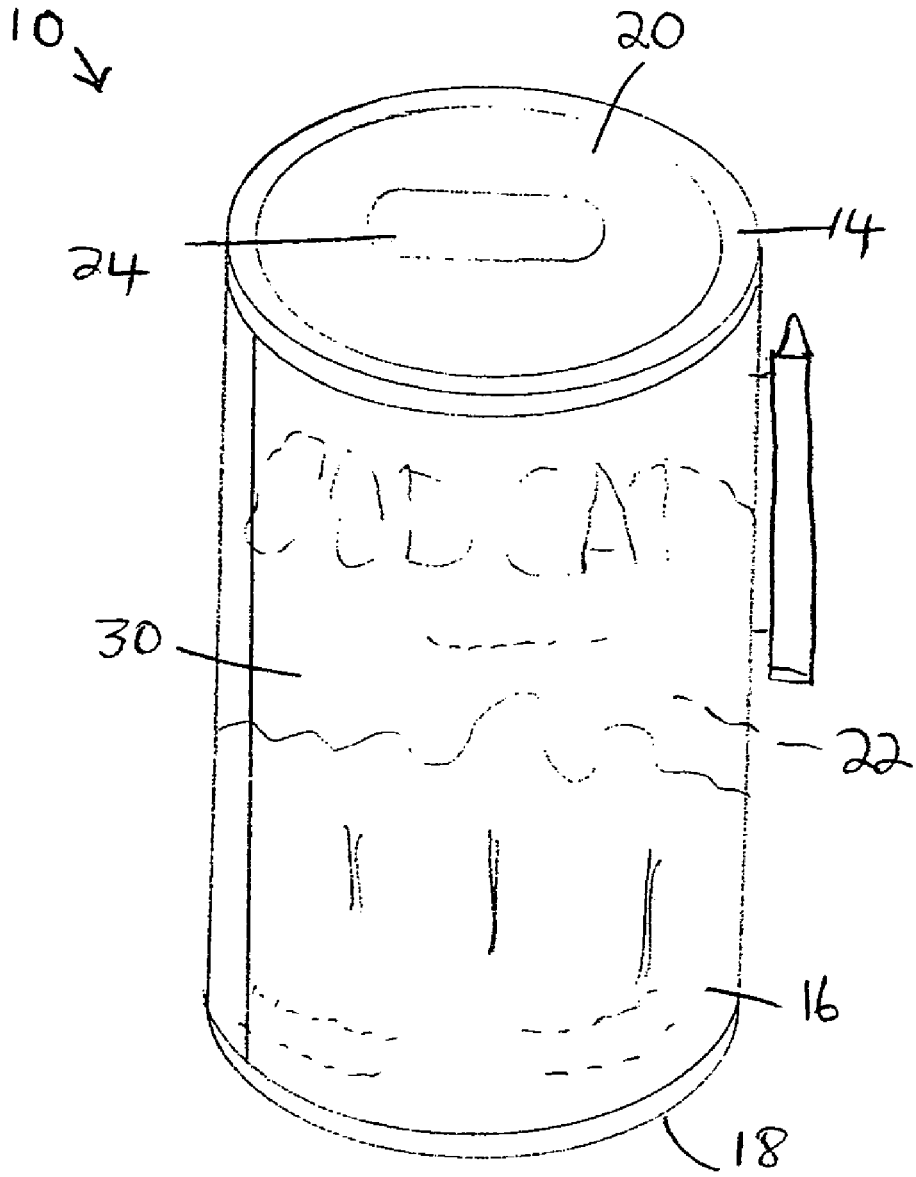
FIG. 1 is a perspective view of a container and booklet in accordance with one aspect of the invention.

With reference to FIG. 1 of the drawings, there is shown a combination container and label booklet 10 of the invention. The combination comprises a can 14, generally of cylindrical shape, having a side wall 16, a bottom wall 18, and a top wall 20. The various walls 16, 18 and 20 respectively together define a space 22 inside the can 14 for receiving written messages, as will be described.

The top wall 20 of the can 14 includes a generally elongate slot 24, through which written messages may be deposited into the space 22. The can 14 may be made of metal, plastic, cardboard or indeed any other material which may be considered suitable and appropriate in the circumstances.

A label and booklet 30 covers the side wall 16 of the can 14. When lain out flat, as shown in subsequent illustrations, the label and booklet 30 has a length which is just slightly more than the circumference of the can 14, so that there is a slight overlap. As will be described, one edge of the label and booklet 30 may, in one embodiment of the invention, have an adhesive strip therealong for securing the label and booklet 30 onto the circumference of the can 14 in any suitable manner.

In use, the label and booklet 30 comprises a booklet section, to be described, stored against the side wall 16 of the can 14. The booklet section can be opened and closed, as desired, and a page or sheet removed therefrom for use as a medium for writing an inspirational and/or spiritual message on the sheet, which can thereafter be deposited in the space 22 through slot 24.

Figure 2:
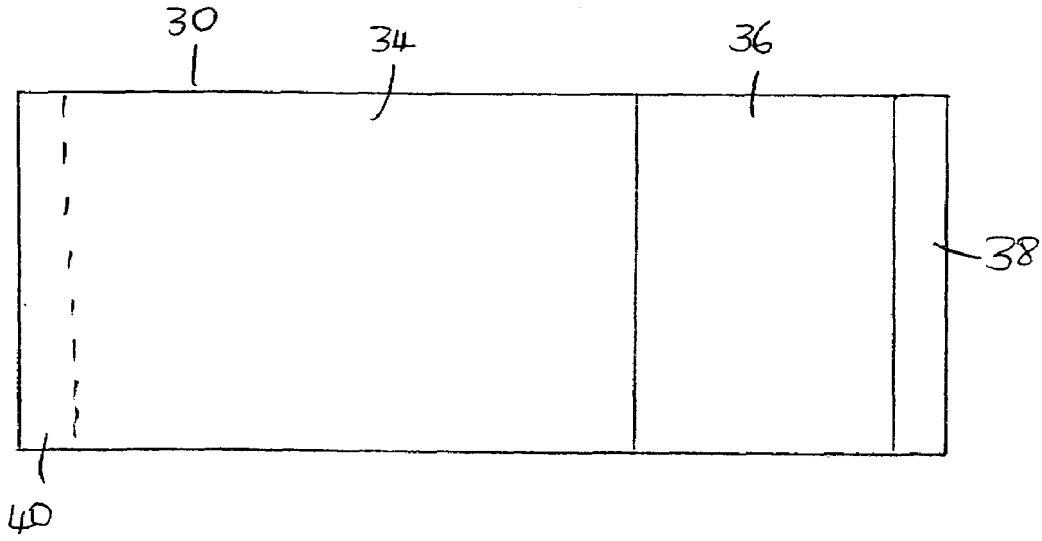
FIG. 2 is a schematic plan view of a label and booklet for mounting around a container, as shown in FIG. 1, with the booklet in a closed position.

Reference is now made to FIG. 2 of the drawings which shows the label and booklet 30 in a schematic or diagrammatic representation, laying flat, or opened. While the label and booklet 30 is indeed shown to be generally flat in FIG. 2 and other figures of the drawings, it will be appreciated that, in accordance with an embodiment of the invention, the various layers to be described and which comprise the label and booklet 30 may be fixed together so as to provide a gentle arc-like profile or arched structure to ensure that it will fit snugly and properly around the can 14. Obviously, the degree of arching can be varied and configured based on the actual dimensions and circumference of the can 14 on which it is mounted.

The label and booklet 30 comprises a label portion 34 and a booklet portion 36. There is also provided an end strip 38, which folds over and adheres to the end strip 40 on the other side of the label 30, when the label 30 is mounted around the side wall 16 of the can 14.

The label portion 34 may have any desired form of content thereon, such as pictures, written material, or a combination of both, in order to convey the intent, theme and/or mood of the container and label 10 of the invention. The invention is not in any way limited by the nature of the material, if any, which may be illustrated on the label.

The book portion 36, as shown in FIG. 2 of the drawings, has a book cover 42, and the booklet 44 therebelow which preferably comprises a plurality of overlying and registering sheets of paper. It will be seen that the book cover 42 has a stick-down edge 46 which extends beyond the side edge 48 of pages which form the booklet 44. The stick-down edge 46 has on its underside an adhesive material which allows it to be repeatedly applied to and removed from the surface, typically comprising the end strip 38, so that the booklet 44 can be opened and closed multiple times, as needed.

Figure 3:
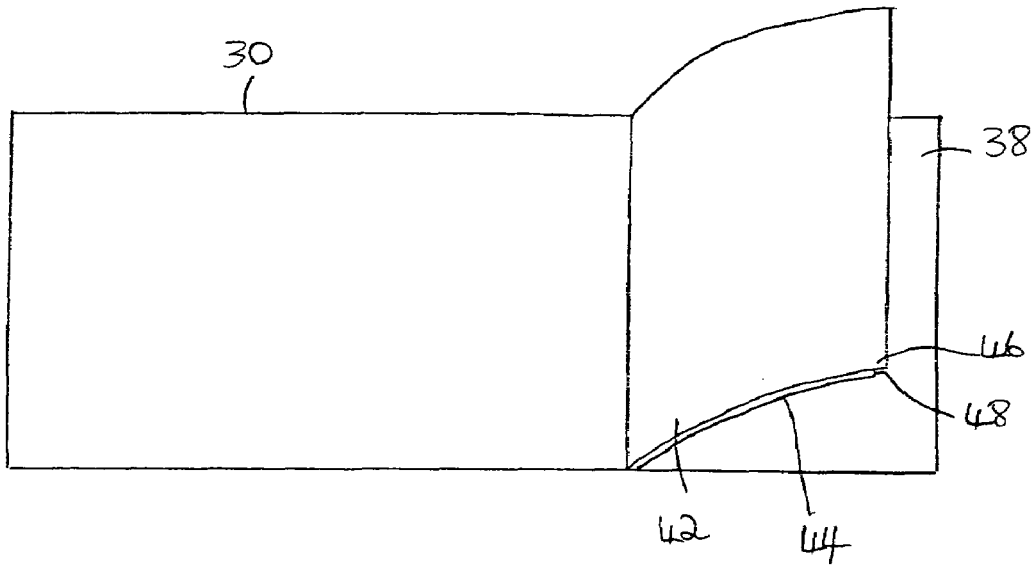
FIG. 3 is a schematic view of the label and booklet as shown in FIG. 2, with the booklet in the partially open position.
Figure 4:
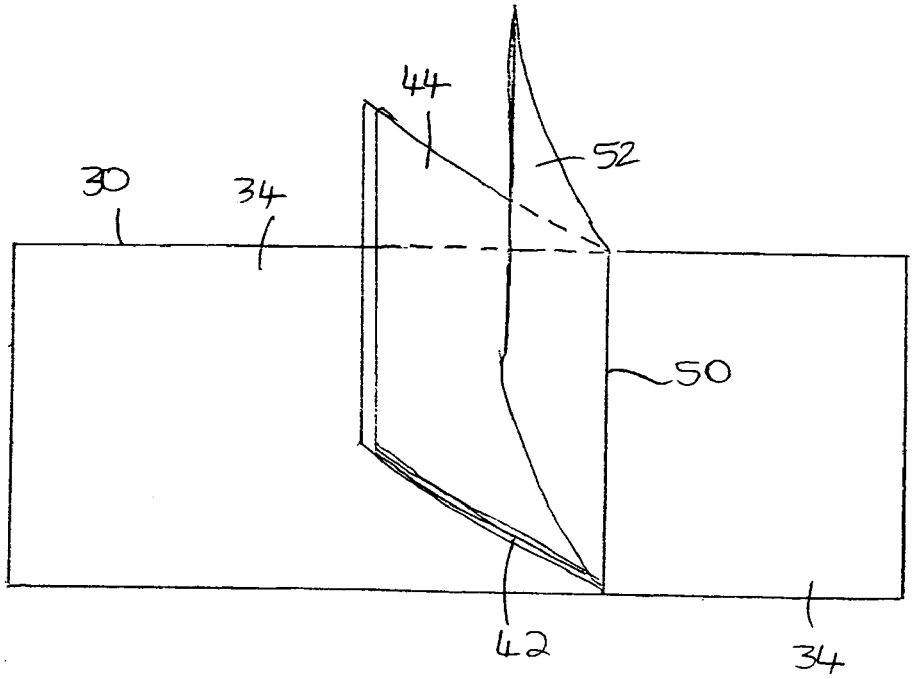
FIG. 4 is a view of the label and booklet as shown in FIG. 3, with the booklet open and a single sheet of paper separated from the booklet for subsequent tearing out or removal.
Figure 5:
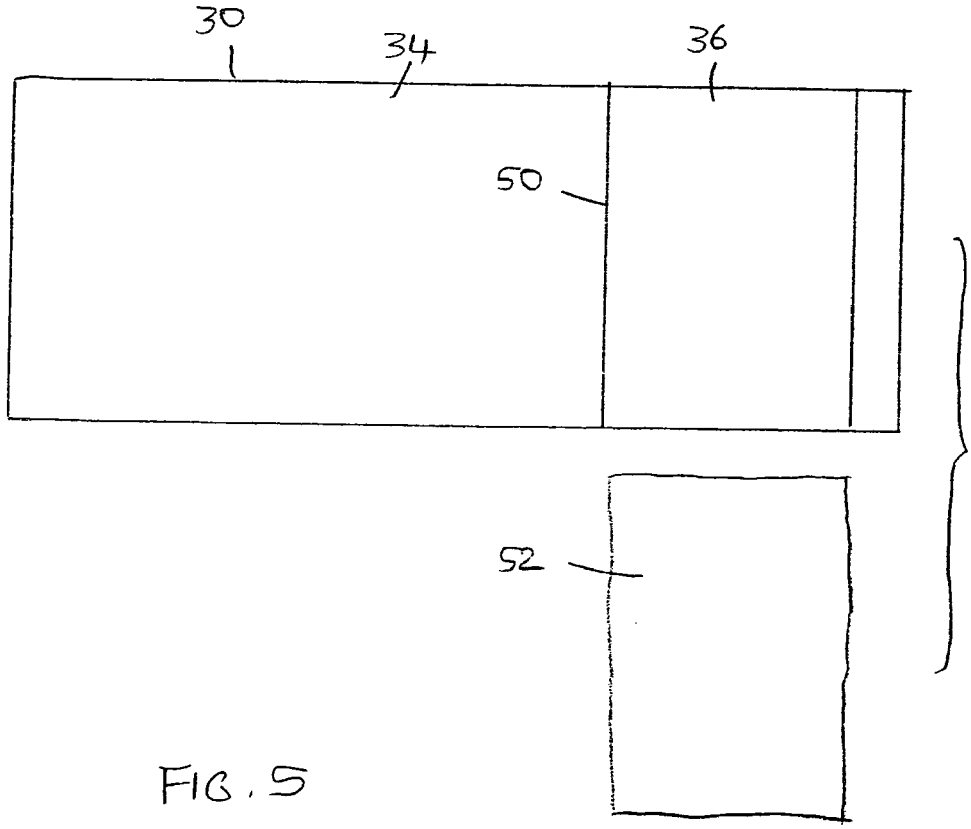
FIG. 5 is a schematic top view of the label with booklet as shown in FIGS. 2 to 4, with the booklet closed and sealed, and one page removed.

In FIG. 4 of the drawings, there is shown a label and booklet 30, as shown in FIG. 3, but with the book cover 42 folded back even further, rotating about the pivot edge 50. In FIG. 4 it is shown that the lowermost page 52 has been separated from the remainder of the booklet 44, ready to be torn out and removed by the user. Once this tearing out of the page 52 has been effected, the book cover 42 is folded back over the label portion 44, as shown in FIG. 5. The page 52 removed is shown separately from the label and booklet 30, and can be written on by the user, and thereafter folded, if desired, and inserted into the space 22 through slot 24.

Figure 6:
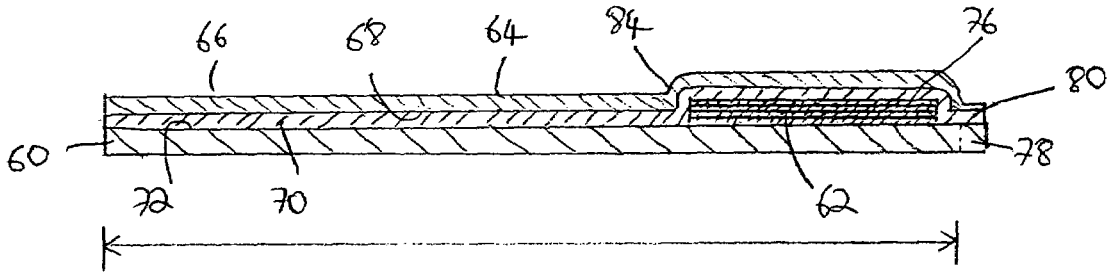
FIG. 6 is a schematic cross-sectional view through a label and booklet in accordance with an aspect of the invention.

Reference is now made to FIG. 6 of the drawings, which shows schematically the various layers which may comprise a label and booklet 30 in accordance with the invention. The lowermost layer comprises a label 60. On one side of the label 60, namely the upper surface thereof, there is mounted a plurality of pages 62 in book form of one type or another. A cover 64, having an upper surface 66 and a lower surface 68 is provided. On the lower surface 68 of the cover 64 there is formed an adhesive layer 70. The adhesive layer 70 effectively joins or fastens the upper surface 72 of the label 60, and the lower surface 68 of the cover 64. The adhesive layer 70 further adheres to the top page 76 of the pages 62, and extends just past the edge of the pages 62 so as to adhere to the label 60 at its book edge 78. It will be noted that the cover 64 and adhesive layer 70 extend a short distance beyond the pages 62 to form a temporary fastener 80 at the book edge 78. In order to facilitate the temporary fastener 80 being easily peelable or removable off or from the book edge 78, an appropriate deadener or other material may be optionally placed on the upper surface of the book edge 78, or on the adhesive layer 70, as may be considered suitable, so as to allow the temporary fastener 80 to adhere to the book edge 78 to keep the pages stored when not needed, but to be easily removable therefrom upon peeling back of the cover 64 so as to expose the pages 62 and allow the removal of one of the pages for use for a written message.

Once the temporary fastener 80 has been lifted off the book edge 78, the pages 62 are opened when the cover 64 pivots around the pivot point 84 so that one of the pages 62 can be removed, as has already been described.

It will be appreciated that the invention may take many different forms and embodiments. For example, while the container in the specific description above is shown as cylindrical, it may be of any shape. Thus, it may have square cross-section, be cubed in shape, or have a shape of a religious icon or other object. Furthermore, while the label and booklet is shown in the Figures as completely surrounding the side walls of the container, it will be appreciated that there need not be a label aside from the booklet, and that the booklet or pages can be mounted on any part or parts of the container.

Further, instead of there being a slot, any other mechanism allowing either inserting or removing of papers from the container may be provided. The entrance or exit may be covered by a door, a flap, have any particular shape and be of any particular size. In one embodiment, the entire top of the container may be open to receive papers.

Furthermore, and in accordance with other embodiments of the invention, the pages 62 may be in a booklet form, bound along one edge thereof, or they may be in a zigzag form and configuration, so that they unfold, and preferably have scored or serrated lines between respective pages so that one page can be easily removed from each of the other pages. Although only one booklet or series of pages is shown in the drawings, there may in fact be more than one booklet, each booklet being formed over a separate or distinct portion of the container in different embodiments, and each booklet mounted on the outside surface of a container may comprise anything from a single sheet of paper to a feasible number of stacked pages, depending upon the thickness, texture and makeup of the paper.

The invention may also incorporate other features, such as a writing implement in the form of a pen or pencil which can be realizable secured, in one form or another, to the container, so that it will be readily and conveniently available for a user who wishes to create a message.

In accordance with yet a further aspect of the invention, there is provided a method whereby a booklet, either alone or when attached to and part of a label, is placed over a container defining a space and intended for receiving inspirational, creative and/or spiritual messages.

The invention is not limited to the precise details described above, and diversified configurations and variations of the container, booklet, and combination thereof, may be made in accordance with the wide scope of the invention.

The invention claimed is:

1. A container and booklet combination comprising:

a container having walls defining a space, the walls having at least an insert aperture in the form of a narrow slot;

a booklet mounted on a label, the label being mounted on the container, the label being larger in at least one dimension than the booklet, the booklet comprising a plurality of media sheets mounted on at least a portion of the outer surface of the container in a manner which allows removal of one of the media sheets from the plurality of media sheets, the media sheets being configured so as to be placed in the container through the insert aperture, the insert aperture being configured so that sheets from the booklet can be placed in the container through the slot but cannot be retrieved from the container through the slot.

2. A container and booklet combination as claimed in claim 1 wherein the container is cylindrical.

3. A container and booklet combination as claimed in claim 1 wherein the media sheets are comprised of paper.

4. A container and booklet combination as claimed in claim 1 wherein the container has side walls, a closed lower wall and an upper wall having an opening or slot therein.

5. A container and booklet combination as claimed in claim 1 wherein the label comprises material of an inspirational or spiritual nature.

6. A container and booklet combination as claimed in claim 1 wherein the booklet comprises a plurality of media sheets mounted over each other in a stacked formation, and joined along a common edge thereof.

7. A container and booklet combination as claimed in claim 1 wherein the media sheets are folded in a zigzag fashion, each media sheet being separated from its adjacent media sheets by a score line to facilitate easy removal of a media sheet.

8. A container and booklet combination as claimed in claim 1 wherein the booklet has a cover thereover, the cover having a fastening edge for fastening the sheets on the label.

9. A container and booklet combination as claimed in claim 8 wherein the cover edge has an adhesive thereon which allows multiple separation and re-adherence of the cover edge to the label.

10. A container and booklet combination comprising:

a container having walls defining a space, the walls having at least an insert aperture in the form of a narrow slot;

a booklet comprising a plurality of media sheets which are folded in a zigzag fashion, each media sheet being separated from its adjacent media sheets by a score line to facilitate easy removal of a media sheet, the booklet being mounted on at least a portion of the outer surface of the container in a manner which allows removal of one of the media sheets from the plurality of media sheets, the media sheets being configured so as to be placed in the container through the insert aperture, the insert aperture being configured so that sheets from the booklet can be placed in the container through the slot but cannot be retrieved from the container through the slot.

* * * * *